US005998124A

United States Patent [19]

Ohzeki et al.

[11] Patent Number: 5,998,124

[45] **Date of Patent: *Dec. 7, 1999**

[54] PRODUCTION METHOD OF PHOTOGRAPHIC SILVER HALIDE EMULSION

[75] Inventors: Katsuhisa Ohzeki; Shoji Ishiguro; Tetsuro Kojima; Yasuhiro Mitamura, all of Kanagawa, Japan

[73] Assignee: Fuji Photo Film Co., Ltd., Kanagawa, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/835,198

[22] Filed: Apr. 7, 1997

Related U.S. Application Data

[63] Continuation of application No. 08/572,170, Dec. 13, 1995, abandoned.

[30] Foreign Application Priority Data

Dec. 19, 1994 [JP] Japan ..... 6-333780
May 23, 1995 [JP] Japan ..... 7-146891

[51] Int. Cl.[6] ..... G03C 1/10; G03C 1/015; G03C 1/035

[52] U.S. Cl. ..... 430/569; 430/600; 430/613

[58] Field of Search ..... 430/569, 600, 430/613

[56] References Cited

U.S. PATENT DOCUMENTS 4,983,508 1/1991 Ishiguro et al. ..... 430/569
5,432,052 7/1995 Ohshima ..... 430/569
5,691,128 11/1997 Ohzeki et al. ..... 430/569

FOREIGN PATENT DOCUMENTS 619517 10/1994 European Pat. Off. ..... G03C 7/30

*Primary Examiner*—Mark F. Huff
*Attorney, Agent, or Firm*—Sughrue, Mion, Zinn, Macpeak & Seas, PLLC

[57] ABSTRACT

A method for producing a photographic silver halide emulsion containing silver halide grains having a silver chloride content of 50 mol % or more and at least 30% of the surface area of the grains comprising [111] faces is disclosed, wherein the silver halide grains are formed in the presence of at least one kind of compounds represented by formula (I):

(I)

wherein $R_1$ represents an alkyl group, an alkenyl group, or an aralkyl group; $R_2$, $R_3$, $R_4$, $R_5$, and $R_6$ each represents a hydrogen atom or a group capable of substituting for the hydrogen atom, $R_2$ and $R_3$, $R_3$ and $R_4$, $R_4$ and $R_5$, and $R_5$ and $R_6$ each may be ring-condensed, provided that at least one of $R_2$, $R_3$, $R_4$, $R_5$, and $R_6$ represents an aryl group; and $X^-$ represents a counter anion.

5 Claims, 1 Drawing Sheet

PRODUCTION METHOD OF PHOTOGRAPHIC SILVER HALIDE EMULSION

This is a Continuation of application Ser. No. 08/572,170 filed Dec. 13, 1995 now abandoned.

FIELD OF THE INVENTION

The present invention relates to a method for producing a photographic silver halide emulsion, and more specifically to a method for producing a photographic silver halide emulsion comprising a tetradecahedral, octahedral, or tabular silver chloride, or silver chlorobromide, silver chloroiodide, or silver chloroiodo-bromide having a high silver chloride content, each having [111] faces.

BACKGROUND OF THE INVENTION

Silver chloride grains or silver halide grains having a high silver chloride content (the silver halide grains mean silver halide grains having a silver chloride content of 50 mol % or more and hereinafter are referred to as high silver chloride grains) are materials well-known in the field of the art and are practically used as light-sensitive materials for printing or photographic printing papers. The increase of the silver chloride content in silver halide grains has a merit in the following points.

(1) Since the solubility of the silver halide grains is increased, the development and the fix are attained in a short time and the light-sensitive materials suitable for rapid processing are obtained.

(2) The absorption in the visible region is reduced (the inherent light sensitivity is reduced) and the separability from the spectrally sensitized region is improved.

On the other hand, silver halide grains having [111] faces mainly as the outer surfaces (hereinafter, the silver halide grains are referred to as [111] type silver halide grains or [111] type grains) are well-known materials in the field of the art and in light-sensitive materials for general photograph, the [111] type silver iodobromide grains are most usually used. In particular, [111] type tabular grains have the advantages that the grains can be effectively spectrally sensitized owing to the large specific surface area (the ratio of the surface area to the volume), the covering power after development is large, etc.

In an ordinary production condition, the high silver chloride grains tend to become grains having the [100) faces as the outer surfaces (hereinafter, the grains are referred to as [100] type grains) and hence for producing the [111] type grains, a specific means is required.

Wey (U.S. Pat. No. 4,399,215) discloses a method for producing high silver chloride tabular grains using ammonia. However, in the case of the tabular grains produced by the method, silver halide grains having a high solubility are produced at a higher solubility owing to the use of ammonia, whereby it is difficult to produce the practically useful small-sized tabular grains. Also, since in the method, pH at the production is high as 8 to 10, the method has a disadvantage that fog is liable to form.

Maskasky (U.S. Pat. No. 5,061,617) discloses high silver chloride {111} type grains produced using a thiocyanate. However, a thiocyanate increases the solubility of silver chloride grains as the case of using ammonia.

Also, for forming the [111] faces as the outer surfaces in high silver chloride grains, a method of adding an additive (a crystal habit controlling agent (i.e., a growth modifier)) at the formation of the silver halide grains are known as shown below.

| (U.S. Pat. No. ) | (Crystal Habit Controlling Agent) | (Inventor) |
|---|---|---|
| U.S. Pat. No. 4,400,463 | Azaindenes + thioether peptizer | Maskasky |
| U.S. Pat. No. 4,783,398 | Dithiazolidine-2,4-dione | Takada |
| U.S. Pat. No. 4,713,323 | Aminopyrazolopyrimidine | Maskasky |
| U.S. Pat. No. 4,983,508 | Bispyridinium salt | Ishiguro |
| U.S. Pat. No. 5,185,239 | Triaminopyrimidine | Maskasky |
| U.S. Pat. No. 5,178,997 | 7-Azaindol compounds | Maskasky |
| U.S. Pat. No. 5,178,998 | Xanthine | Maskasky |
| JP-A-64-70741 | Dyes | Nishikawa |
| JP-A-3-212639 | Aminothioether | Ishiguro |
| JP-A-4-283742 | Thiourea derivatives | Ishiguro |
| JP-A-4-335632 | Triazolium salts | Ishiguro |

(The term "JP-A" as used herein means as an "unexamined published Japanese patent application").

As described above, various crystal habit controlling agents are disclosed but for producing more preferable high silver chloride tabular grains, the development of new crystal habit controlling agents has been desired.

As the properties required for the crystal habit controlling agents, it is particularly important that the crystal habit controlling agent does not reduce the photographic sensitivity and does not hinder the adsorption of dyes for spectral sensitization. In this point, the use of the azaindenes or the pyrimidines is undesirable.

Furthermore, Maskasky (EP 584817A1) discloses a method of desorbing the crystal habit controlling agent by lowering pH and then exchange-absorbing an oxacarbocyanine dye containing iodine, for keeping the form of [111] tabular grains. However, such the exchange absorption method becomes a large load in the production.

SUMMARY OF THE INVENTION

The object of the present invention is to develop a new method for producing high silver chloride [111] type grains and to provide high silver chloride [111] type grains readily absorbing dyes, which contributes to the production of light-sensitive materials having excellent photographic characteristics.

The object of the present invention described above can be attained by the following method of the present invention.

1. A method for producing a photographic silver halide emulsion containing silver halide grains having a silver chloride content of 50 mol % or more and at least 30% of the surface area of the grains comprising [111] faces, wherein the silver halide grains are formed in the presence of at least one kind of compounds represented by formula (I);

(I)

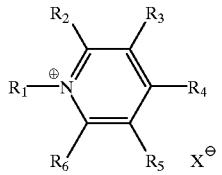

wherein $R_1$ represents an alkyl group, an alkenyl group, or an aralkyl group, $R_2$, $R_3$, $R_4$, $R_5$, and $R_6$ each represents a hydrogen atom or a group capable of substituting for the hydrogen atom, $R_2$ and $R_3$, $R_3$ and $R_4$, $R_4$ and $R_5$, and $R_5$ and $R_6$ each may be ring-condensed, provided that at least one of $R_2$, $R_3$, $R_4$, $R_5$, and $R_6$ represents an aryl group; and $X^-$ represents a counter anion.

The preferred embodiments of the method for producing the photographic silver halide emulsion of the present invention are as follows.

2. The method for producing a photographic silver halide emulsion described in the above method 1, wherein $R_4$ in the formula (I) is an aryl group.

3. The method for producing a photographic silver halide emulsion described in the above method 1, wherein $R_1$ in the formula (I) is an aralkyl group.

4. The method for producing a photographic silver halide emulsion described in the above method 2, wherein $R_1$ in the formula (I) is an aralkyl group.

DETAILED DESCRIPTION OF THE INVENTION

Figure 1:
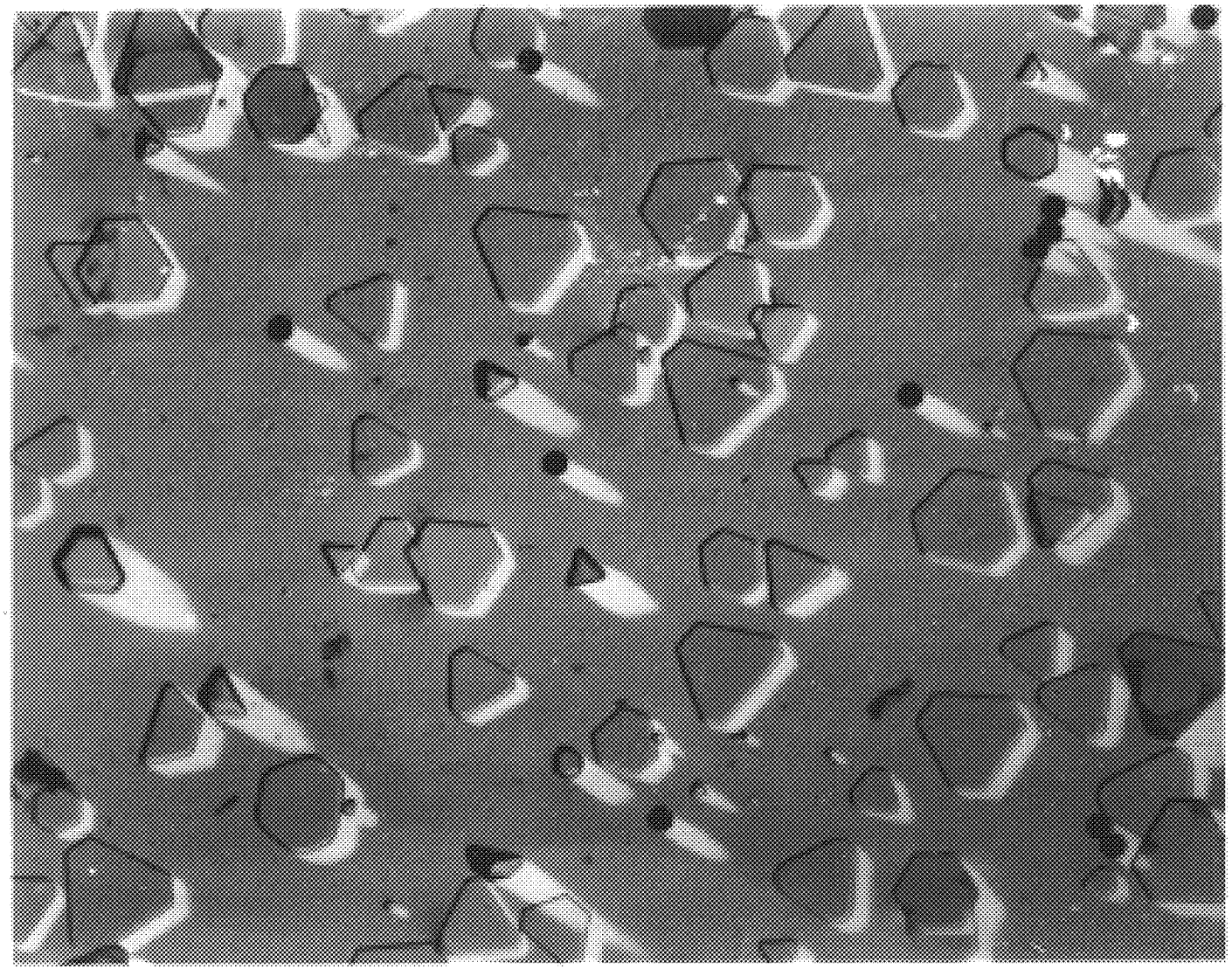
FIG. 1 is an electron photomicrograph of the grain structure at 3,000 magnifications of the tabular silver halide grains obtained using the crystal habit controlling agent-1 of the present invention in Example 2. The black spots in FIG. 1 are latex particles having a diameter of 0.5 $\mu$m.

The present invention is described in detail below.

First, the compound represented by the formula (I) used in the present invention is explained in detail.

In the formula (I), $R_1$ represents preferably a straight chain, branched, or cyclic alkyl group having from 1 to 20 carbon atoms (e.g., methyl, ethyl, isopropyl, t-butyl, n-octyl, n-decyl, n-hexadecyl, cyclopropyl, cyclopentyl, and cyclohexyl), an alkenyl group having from 2 to 20 carbon atoms (e.g., allyl, 2-butenyl, and 3-pentenyl) or an aralkyl group having from 7 to 20 carbon atoms (e.g., benzyl and phenetyl). Each group represented by $R_1$ may be substituted. As the substituent, there are groups capable of substituting (i.e., substitutable groups) represented by the following $R_2$, $R_3$, $R_4$, $R_5$, and $R_6$.

In the formula (I), $R_2$, $R_3$, $R_4$, $R_5$, and $R_6$, which may be the same or different, each represents a hydrogen atom or a group (i.e., a substitutable grop) capable of substituting for the hydrogen atom. As the substitutable groups, there are following groups.

That is, examples of the substitutable groups include a halogen atom (e.g., fluorine, chlorine, and bromine), an alkyl group (e.g., methyl, ethyl, n-propyl, isopropyl, t-butyl, n-octyl, cyclopentyl, and cyclohexyl), an alkenyl group (e.g., allyl, 2-butenyl, and 3-pentenyl), an alkynyl group (e.g., propargyl and 3-pentinyl), an aralkyl group (e.g., benzyl and phenetyl), an aryl group (e.g., phenyl, naphthyl, and 4-methylphenyl), a heterocyclic group (e.g., pyridyl, furyl, imidazolyl, piperidyl, and morpholino), an alkoxy group (e.g., methoxy, ethoxy, and butoxy), an aryloxy group (e.g., phenoxy and 2-naphthyloxy), an amino group (e.g., unsubstituted amino, dimethylamino, ethylamino, and anilino), an acylamino group (e.g., acetylamino and benzoylamino), a ureido group (e.g., unsubstituted ureido, N-methylureido, and N-phenylureido), a urethane group (e.g., methoxycarbonylamino and phenoxycarbonylamino), a sulfonylamino group (e.g., methylsulfonylamino and phenylsulfonylamino), a sulfamoyl group (e.g., unsubstituted sulfamoyl, N,N-dimethylsulfamoyl, and N-phenylsulfamoyl), a carbamoyl group (e.g., unsubstituted carbamoyl, N,N-diethylcarbamoyl, and N-phenylcarbamoyl), a sulfonyl group (e.g., mesyl and tosyl), a sulfinyl group (e.g., methylsulfinyl and phenylslfinyl), an alkyloxycarbonyl group (e.g., methoxycarbonyl and ethoxycarbonyl), an aryloxycarbonyl group (e.g., phenoxycarbonyl), an acyl group (e.g., acetyl, benzoyl, formyl, and pivaloyl), an acyloxy group (e.g., acetoxy and benzoyloxy), phosphoric acid amido group (e.g., N,N-diethylphosphoric acid amido), an alkylthio group (e.g., methylthio and ethylthio), an arylthio group (e.g., phenylthio), a cyano group, a sulfo group, a carboxy group, a hydroxy group, a phosphono group, a nitro group, a sulfino group, an ammonio group (e.g., trimethylammonio), a phosphonio group, a hydrazino group, etc. These groups may be further substituted. Also, when there are two or more substituents, they may be the same or the different.

In the formula (I), $R_2$ and $R_3$, $R_3$ and $R_4$. $R_4$ and $R_5$, and $R_5$ and $R_6$ may be ring-condensed to form a quinoline ring, an isoquinoline ring, or an acridine ring.

$X^-$ represents a counter anion. Examples of the counter anion include a halogen ion (e.g., a chlorine ion and a bromine ion), a nitrate ion, an sulfate ion, a p-toluenesulfonate ion, a trifluoromethanesulfonate ion, etc.

In the formula (I), it is preferred that $R_1$ represents an aralkyl group and at least one of $R_2$, $R_3$, $R_4$, $R_5$, and $R_6$ represents an aryl group.

Also, in the formula (I), it is more preferred that $R_1$ represents an aralkyl group, $R_4$ represents an aryl group, and $X^-$ represents a halogen ion.

Specific examples of the compound represented by formula (I) are shown below but the compounds of the formula (I) for use in the present invention are not limited to them.

1.

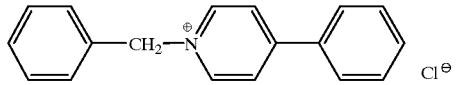

2.

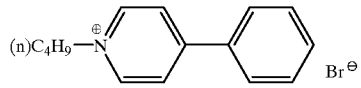

3.

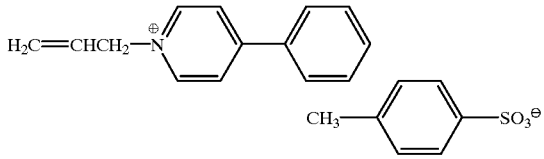

4.

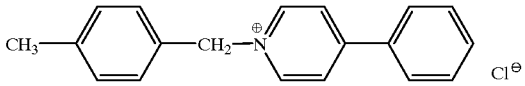

5.

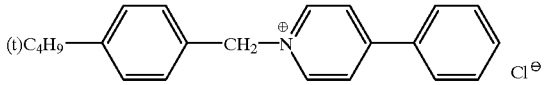

6.

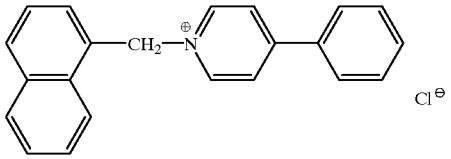

-continued
7.
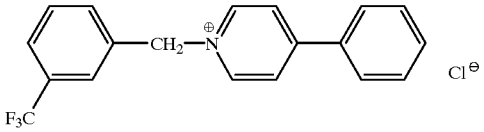
8.
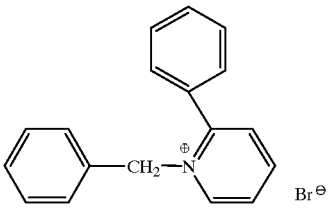
9.
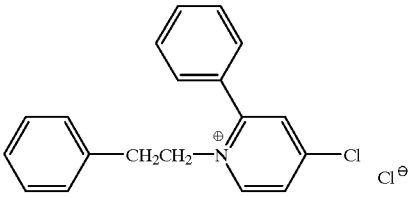
10.
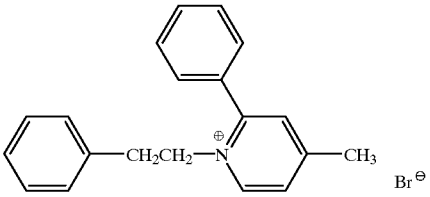
11.
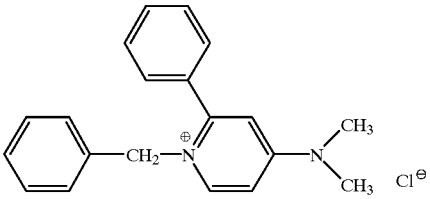
12.
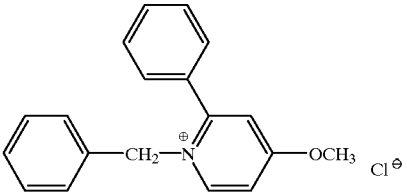
13.
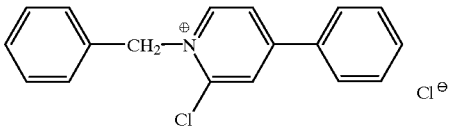
14.
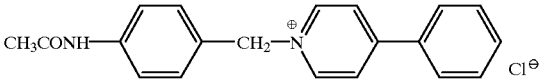
-continued
15.
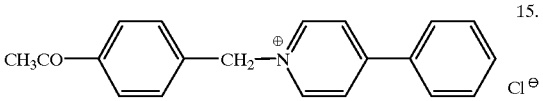
16.
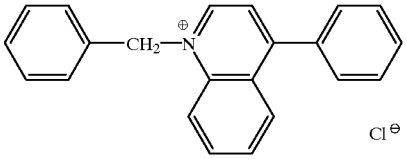
17.
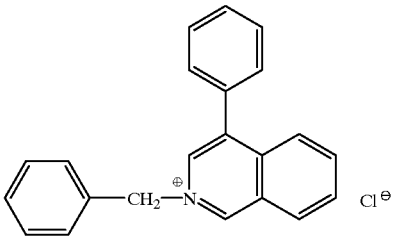
18.
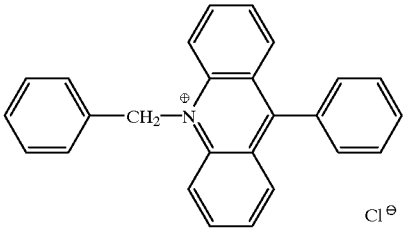
19.
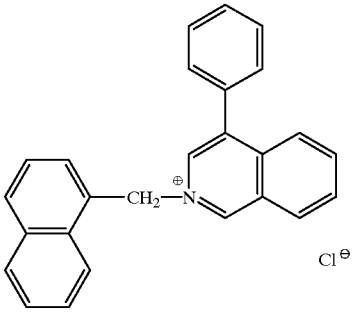
20.
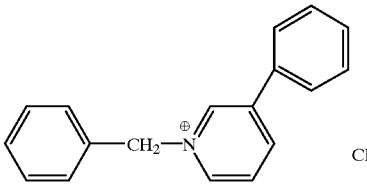
21.
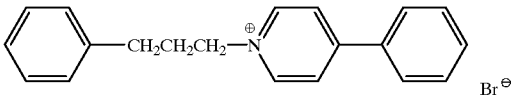

-continued

22.

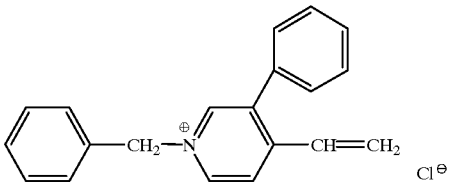

23.

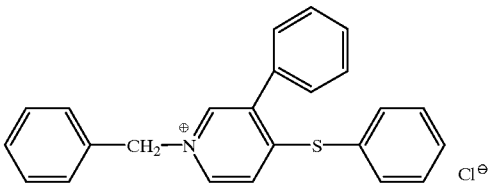

24.

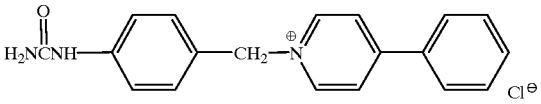

25.

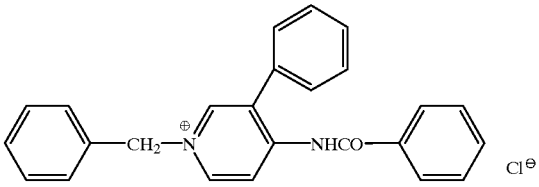

26.

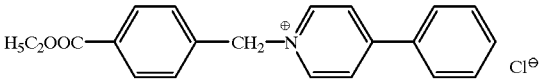

27.

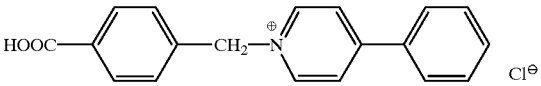

28.

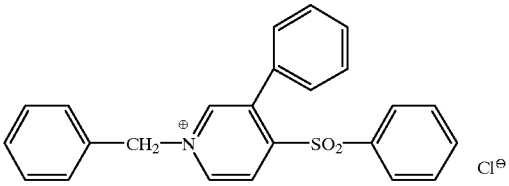

29.

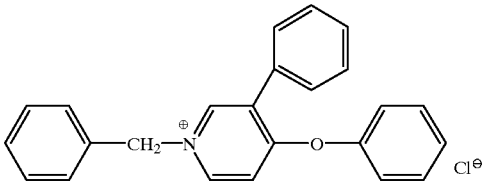

The compound represented by the formula (I) can be easily synthesized by the reaction of pyridine, quinoline, isoquinoline, an acridine compound, etc., which can be easily commercially available and an alkylating agent such as a halogenated alkyl, etc., but a specific synthetic example of the typical compound represented by formula (I) is shown below.

Synthesis Example 1 (Compound 1)

To 310.4 g (2 mols) of 4-phenylpyridine was added 1.5 liters of isopropyl alcohol and then 379.6 g (3 mols) of benzyl chloride was added dropwise at room temperature. Thereafter, the resultant mixture was refluxed for 4 hours, 750 ml of isopropyl alcohol was distilled off under reduced pressure, and after cooling the concentrated residue to room temperature, crystals deposited were collected by suction-filtration to provide 447.1 g (yield 79.3%) of the desired product having a melting point of 230° C. or more. From the nuclear magnetic resonance spectrum, the mass spectrum, the infrared absorption spectrum, and the elemental analysis, the product was confirmed to be the desired compound.

The crystal habit controlling agent represented by formula (I) being used in the present invention can be used in the range of generally from $6\times10^{-5}$ to $6\times10^{-1}$ mol, and preferably from $6\times10^{-4}$ mol to $6\times10^{-2}$ mol, per mol of the silver halide in the finished silver halide emulsion.

The addition time of the crystal habit controlling agent may be any time from the nucleation of silver halide grains to the physical ripening, and during the growth of the silver halide grains. After the addition of the crystal habit controlling agent, the formation of [111] faces is initiated.

The crystal habit controlling agent may be previously placed in a reaction vessel or may be added into a reaction vessel with the growth of silver halide grains followed by increasing the concentration of the crystal habit controlling agent.

By using the crystal habit controlling agent of the present invention, regular crystal grains (octahedral to tetradecahedral) and tabular grains each having [111] faces can be produced.

The difference between the formation of the regular crystal grains and the formation of the tabular grains mainly depends upon the nucleation method and the addition time and the addition amount of the crystal habit controlling agent.

(1) The case of producing regular crystal grains:

It is preferred that the crystal habit controlling agent does not exist at the nucleation. The concentration of a chloride at the nucleation is generally not more than 0.6 mole/liter, preferably not more than 0.3 mole/liter, and particularly preferably not more than 0.1 mole/liter.

(2) The case of producing tabular grains:

Tabular silver halide grains are obtained by forming two parallel twin planes. Since the formation of the twin planes depends upon the temperature, the dispersion medium (gelatin), the halogen concentration, etc., proper conditions of them must be established. In the case of existing the crystal habit controlling agent at the nucleation, the concentration of gelatin is generally from 0.1 wt % to 10 wt %, and preferably from 0.15 wt % to 5 wt %. Also, the concentration of a chloride is generally at least 0.01 mol/liter, and preferably at least 0.03 mol/liter.

When the crystal habit controlling agent is not used at the nucleation, the concentration of gelatin is generally from 0.03 wt % to 10 wt %, and preferably from 0.05 wt % to 1.0 wt %. The concentration of a chloride is generally from 0.001 mol/liter to 1 mol/liter, and preferably from 0.003 mol/liter to 0.1 mol/liter. Also, the nucleation temperature can be optionally selected in the range of from 2° C. to 80° C. but is preferably from 5° C. to 90° C., and particularly preferably from 5° C. to 40° C.

Then, in the case of physically ripening the nuclei formed and growing the nuclei by addition of a silver salt and a halide in the presence of the crystal habit controlling agent, the concentration of a chloride is generally not more than 5 mols/liter, and preferably from 0.08 mol/liter to 2 mols/liter. The temperature at the grain growth can be selected in the range of from 10° C. to 90° C. but is preferably the range of from 30° C. to 80° C. When the amount of the dispersion medium used at the nucleation is insufficient for the growth of the nuclei, it is necessary to replenish the dispersion medium by the addition thereof. For the growth of the nuclei, it is preferred that from 10 g/liter to 60 g/liter of gelatin exists. Also, pH at the grain growth may be optional but the range of from neutral to acidic is preferred.

The high silver chloride grains in the present invention are the silver halide grains having a silver chloride content of 50 mol % or more. In the present invention, the silver chloride content is preferably 80 mol % or more, and particularly preferably 95% mol % or more. Other portion than silver chloride is composed of silver bromide and/or silver iodide. The silver iodobromide layer can locally exist at the surfaces of the silver halide grains. This is preferred for the adsorption of sensitizing dyes. Also, the silver halide grains may be so-called core/shell type grains.

The content of silver iodide is generally not more than 20 mol %, preferably not more than 10 mol %, and particularly preferably not more than 3 mol %.

The silver halide grains produced by the method of the present invention have the surface composed of [111] face and at least 30%, preferably at least 40%, and particularly at least 60% of the total surface area is composed of [111] face. The [111] face can be determined from the electron photomicrograph of the silver halide grains formed.

When the silver halide grains of the present invention are regular crystals, there is no particular restriction on the average grain size thereof but the average grain size is usually from 0.1 $\mu$m to 5 $\mu$m, and preferably from 0.2 $\mu$m to 3 $\mu$m.

When the silver halide grains of the present invention are tabular silver halide grains, the ratio of the diameter/thickness is generally at least 2, preferably from 2 to 20, and particularly preferably from 3 to 10. In this case, the diameter of the silver halide grains is the diameter of a circle having the same area as the projected area of the grains in the electron photomicrograph.

In the present invention, the diameter of the tabular silver halide grains is generally from 0.3 $\mu$m to 5.0 $\mu$m, and preferably from 0.5 $\mu$m to 3.0 $\mu$m. Also, the thickness of the tabular silver halide grain is generally not more than 0.4 $\mu$m, preferably not more than 0.3 $\mu$m, and particularly preferably not more than 0.2 $\mu$m. Also, the volume load average volume of the tabular silver halide grains is preferably not more than 2 $\mu m^3$ and particularly preferably not more than 1 $\mu m^3$.

In general, the tabular silver halide grains are tabular grains having two parallel surfaces and hence the thickness in the present invention is expressed by the distance between the two parallel planes constituting the tabular silver halide grain.

The distribution of the grain sizes of the silver halide grains of the present invention may be a polydispersed system or a monodispersed system but is more preferably a monodispersed system.

The silver halide emulsion of the present invention may be an internal latent image-type emulsion or a surface latent image-type emulsion.

At the production of the silver halide grains of the present invention, a silver halide solvent may be used.

Examples of the silver halide solvent which is generally used, include thiocyanates as described in U.S. Pat. Nos. 2,222,264, 2,448,534, and 3,320,069; thioether compounds as described in U.S. Pat. Nos. 3,271,157, 3,574,628, 3,704,130, 4,297,439, and 4,276,347; thione compounds and thiourea compounds as described in JP-A-53-144319, JP-A-53-82408, and JP-A-55-77737; and amine compounds as described in JP-A-54-100717 and these silver halide solvents can be used in the present invention. Also, ammonia can be used in the range of causing a bad action.

In the step of forming or physically ripening the silver halide grains, a cadmium salt, a zinc salt, a lead salt, a thallium salt, an iridium salt or a complex salt thereof, a rhodium salt or a complex salt thereof, an iron salt or a complex salt thereof, etc., may exist together. In particular, an iridium salt or a rhodium salt is preferred.

A method of increasing the addition speed, the addition amount, and the addition concentration of a silver salt solution (e.g., an aqueous solution of $AgNO_3$) and a halide solution (e.g., an aqueous NaCl solution), which are added for accelerating the growth of the silver halide grains, in accordance with the addition time in the case of the production of the silver halide grains in the present invention is preferably used.

About these methods, the descriptions of British Patent 1,335,925; U.S. Pat. Nos. 3,672,900, 3,650,757, and 4,242,445; JP-A-55-142329, JP-A-55-158124, JP-A-58-113927, JP-A-58-113928, JP-A-58-111934, and JP-A-58-111936 can be referred to.

The tabular silver halide grains of the present invention may not be chemically sensitized but, if necessary, can be chemically sensitized.

As the chemical sensitizing method, there are a gold sensitizing method using a gold compound as described in U.S. Pat. Nos. 2,448,060 and 3,320,069; a sensitizing method using a metal such as iridium, platinum, rhodium, palladium, etc., as described in U.S. Pat. Nos. 2,448,060, 2,566,245, and 2,566,263; a sulfur sensitizing method using a sulfur-containing compound as described in U.S. Pat. No. 2,222,264; a selenium sensitizing method using a selenium compound; and a reduction sensitizing method using a tin salt, a thiourea dioxide, polyamine, etc., as described in U.S. Pat. Nos. 2,487,850, 2,518,698, and 2,521,925. These sensitizing methods can be used as a combination of two or more methods.

In particular, for the silver halide grains of the present invention, a gold sensitizing method or a sulfur sensitizing, or a combination of them is preferably applied.

The silver halide emulsion layers of the silver halide photographic material of the present invention can further contain ordinary silver halide grains in addition to the silver halide grains of the present invention.

In the photographic silver halide emulsion of the present invention containing the high silver chloride grains in the present invention, the high silver chloride grains exist in an amount of generally at least 50%, preferably at least 70%, and particularly preferably at least 90% of the projected area of the total silver halide grains.

When the photographic silver halide emulsion of the present invention is used as a mixture with other photographic silver halide emulsion, it is preferred that these emulsions are mixed such that the high silver chloride grains of the present invention exist in an amount of at least 50% in the mixed emulsions.

Furthermore, when the photographic silver halide emulsion of the present invention is used as a mixture with other photographic silver halide emulsion, it is more preferred that the latter photographic silver halide emulsion to be mixed is a high silver chloride emulsion.

The silver halide emulsion of the present invention may be spectrally sensitized with methine dyes or the like.

Examples of the spectral sensitizing dyes being used in the present invention includes cyanine dyes, merocyanine dyes, complex cyanine dyes, complex merocyanine dyes, holopolar cyanine dyes, hemicyanine dyes, styryl dyes, and hemioxonol dyes. Particularly useful dyes are the dyes belonging to the cyanine dyes, the merocyanine dyes, and the complex merocyanine dyes.

For these dyes can be applied nuclei ordinary utilized for cyanine dyes as basic heterocyclic nuclei, such as pyrroline nuclei, oxazoline nuclei, thiazoline nuclei, pyrrole nuclei, oxazole nuclei, thiazole nuclei, selenazole nuclei, imidazole nuclei, tetrazole nuclei, pyridine nuclei, etc.; the nuclei formed by fusing an alicyclic hydrocarbon ring to the foregoing nuclei; and the nuclei formed by fusing an aromatic hydrocarbon ring to the foregoing nuclei, such as indolenine nuclei, benzindolenine nuclei, indole nuclei, benzoxazole nuclei, naphthoxazole nuclei, benzothiazole nuclei, naphthothiazole nuclei, benzoselenazole nuclei, benzimidazole nuclei, quinoline nuclei, etc. These nuclei may be substituted on carbon atoms.

For merocyanine dyes or complex merocyanine dyes may be applied 5- or 6-membered heterocyclic nuclei such as pyrazolin-5-one nuclei, thiohydantoin nuclei, 2-thiooxazolidine-2,4-dione nuclei, thiazolidine-2,4-dione nuclei, rhodanine nuclei, thiobarbituric acid nuclei, etc., as a nucleus having a ketomethylene structure.

Also, as the spectral sensitizing dyes, the compounds described in, for example, *Research Disclosure*, Item 17643, page 23, Iv (December 1978) and in the literatures cited therein can be used.

The time for adding the dye to the silver halide emulsion may be at any stage for preparing the emulsion, which is known to be useful. Usually, the dye is added at the time after completing the chemical sensitization before coating the emulsion but the dye is added simultaneously with the chemical sensitizing agent to simultaneously carry out the spectral sensitization with the chemical sensitization as described in U.S. Pat. Nos. 3,628,969 and 4,225,666 or the spectral sensitization can be carried out prior to the chemical sensitization as described in JP-A-58-113928. Also, the dye is added to the emulsion before completing the formation of the precipitation of the silver halide grains to initiate the spectral sensitization. Furthermore, the foregoing dye is added partially, that is a part of the dye is added prior to the chemical sensitization and the residue is added after the chemical sensitization as described in U.S. Pat. No. 4,225,666, and also the spectral sensitization may be carried out at any time during the formation of the silver halide grains as described in U.S. Pat. No. 4,183,756.

The addition amount of the spectral sensitizing dye is generally from $4\times10^{-6}$ to $8\times10^{-3}$ mol per mol of the silver halide and when the grain sizes of the silver halide grains are from 0.2 $\mu$m to 3 $\mu$m, the addition amount thereof is more preferably from $5\times10^{-5}$ mol to $2\times10^{-3}$ mol.

The silver halide emulsions prepared by the method of the present invention can be used for both color photographic light-sensitive materials and black and white photographic light-sensitive materials.

As color photographic light-sensitive materials, there are color photographic (printing) papers, color photographic films, color reversal photographic films, etc., and as black and white light-sensitive materials, there are X-ray photographic films, general black and white photographic films, films for printing light-sensitive materials, etc. The silver halide emulsions of the present invention can be particularly preferably used for color photographic (printing) papers.

There is no particular restriction on other additives for the photographic light-sensitive materials to which the silver halide emulsions of the present invention are applied and the descriptions, e.g., in *Research Disclosure*, Vol. 176, Item 17643 (RD 17643) and *ibid.*, Vol. 187, Item 18716 (RD 18716) can be referred to.

The portions describing various additives in RD 17643 and RD 18716 are shown below.

| Additive | RD 17643 | RD 18716 |
|---|---|---|
| 1 Chemical Sensitizer | p. 23 | p. 648, right column |
| 2 Sensitivity Increasing Agent | | " |
| 3 Spectral Sensitizer, Supersensitizer | pp. 23–24 | p. 648, right column to p. 649 right. column |
| 4 Whitening Agent | p. 24 | |
| 5 Antifoggant and Stabilizer | pp. 14–25 | p. 649, right column |
| 6 Light Absorber, Filter Dye, Ultraviolet Absorber | pp. 25–26 | p. 649, right column to p. 650, left column |
| 7 Stain Inhibitor | p. 25, right column | p. 650, left to right columns |
| 8 Dye Image Stabilizer | p. 25 | |
| 9 Hardening Agent | p. 26 | p. 651, left column |
| 10 Binder | p. 26 | " |
| 11 Plasticizer, Lubricant | p. 27 | p. 650, right column |
| 12 Coating Aid, Surfactant | pp. 26–27 | " |
| 13 Antistatic Agent | p. 27 | " |

Among these additives, as the antifoggants and stabilizers, azoles (e.g., benzothiazolium salts, nitroimidazles, nitrobenzimidazoles, chlorobenzimidazoles, bromobenzimidazoles, nitroindazoles, benzotriazoles, and aminotriazoles); mercapto compounds [e.g., mercaptothiazoles, mercaptobenzothiazoles, mercaptobenzimidazoles, mercaptothiadiazoles, mercaptotetrazoles (e.g., 1-phenyl-5-mercaptotetrazole), mercaptopyrimidines, and mercaptotriazines]; thioketo compounds such as oxadolinethione, etc.; azaindenes (e.g., triazaindenes, tetraazaindenes (in particular, 4-hydroxy-substituted (1,3,3a,7)tetraazaindenes), and pentaazindenes]; benzenesulfonic acid, benzenesulfinic acid, benzenesulfonic acid amide, etc., can be preferably used.

As color couplers (i.e., color-forming couplers), non-diffusible couplers having a hydrophobic group called a ballast group in the molecule or polymerized couplers are desirable. The couplers may be four-equivalent or two-equivalent to a silver ion. Also, the photographic light-sensitive material of the present invention may contain a colored coupler having a color correcting effect or a coupler releasing a development inhibitor with the development (so-called DIR coupler). Also, the photographic light-sensitive material may contain a non-coloring DIR coupling compound which forms a colorless coupling reaction product and releases a development inhibitor.

For example, as magenta couplers, there are 5-pyrazolone couplers, pyrazolobenzimidazole couplers, pyrozolotriazole couplers, pyrazolotetrazole couplers, cyanoacetylcoumarone couplers, open-chain acylacetonitrile couplers, etc.; as yellow couplers, there are acrylacetamide couplers (e.g., benzoylacetanilides and pivaloylacetanilides), etc.; and as cyan couplers, there are naphthol couplers, phenol couplers, etc. As the cyan couplers, the phenolic couplers having an ethyl group at the meta-position of the phenol nucleus, the 2,5-diacylamino-substituted phenolic couplers, the phenolic couplers having a phenylureido group at the 2-position and an acrylamino group at the 5-position, and the couplers having substituted sulfonamide or amide at the 5-position of the naphthol, as described in U.S. Pat. Nos. 3,772,002, 2,772,162, 3,758,308, 4,126,396, 4,334,011, 4,327,173, 3,446,622, 4,333,999, 4,451,559, 4,427,767, etc., are excellent in the fastness of color images formed and preferably used.

The foregoing couplers can be used as a combination of two or more kinds of couplers in a same silver halide emulsion layer for satisfying the properties required for the photographic light-sensitive material or as a matter of course a same coupler may be added to two or more layers of the photographic light-sensitive material.

As anti-fading agents, there are hydroquinones, 6-hydroxychromans, 5-hydroxychromans, spirochromans, p-alkoxyphenols, hindered phenols such as bisphenols, gallic acid derivatives, methylenedioxybenzenes, aminophenols, hindered amines and the ether or ester derivatives obtained by silylating or alkylating the phenolic hydroxy group of each of these compounds as the typical examples thereof. Also, metal complexes such as (bissalicylaldoxymate)nickel complex and (bis-N,N-dialkyldithiocarbamate)nickel complex can be used as the anti-fading agent.

For photographic processing of the photographic light-sensitive materials of the present invention, any known processes can be used and also as the processing solutions, known ones can be used. Also, the processing temperature is usually selected from the range of from 18° C. to 50° C. but, as the case may be, the temperature may be lower than 18° C. or higher than 50° C. According to the purposes, a development process of forming silver images (black and white photographic process) or a color photographic process composed of a development process for forming dye images can be employed.

For a black and white developer, known developing agents such as dihydroxybenzenes (e.g., hydroquinone), 3-pyrazolidones (e.g., 1-phenyl-3-pyrazolidone), aminophenols (e.g., N-methyl-p-aminophenol), etc., can be used singly or as a combination of them.

A color developer is generally composed of an alkaline aqueous solution containing a color developing agent. As the color developing agent, known primary aromatic amino developing agents such as phenylenediamines (e.g., 4-amino-N,N-diethylaniline, 3-methyl-4-amino-N,N-diethylaniline, 4-amino-N-ethyl-N-β-hydroxyethylaniline, 3-methyl-4-amino-N-ethyl-N-β-hydroxyethylaniline, 3-methyl-4-amino-N-ethyl-N-β-methanesulfonamidoethylaniline, and 4-amino-3-methyl-N-ethyl-N-β-methoxyethylaniline) can be used.

Furthermore, the color developers described in L. F. A. Meson, *Photographic Processing Chemistry*, pages 226–229, published by Focal Press, 1966; U.S. Pat. Nos. 2,193,015 and 2,592,364; JP-A-48-64933, etc., may be used.

The color developers can further contain pH buffers such as the sulfites, carbonates, borates, and phosphates of an alkali metal; development inhibitors such as bromides, iodides, and organic antifoggants; antifoggants, etc. Also, if necessary, the color developers may contain hard-water softeners; preservatives such as hydroxylamine, etc.; organic solvents such as benzyl alcohol, diethylene glycol, etc.; development accelerators such as polyethylene glycol, quaternary ammonium salts, amines, etc.; dye-forming couplers; competing couplers; fogging agents such as sodium boron hydride, etc.; auxiliary developing agents such as 1-phenyl-3-pyrazolidone, etc.; tackifiers; the polycarboxylic acid series chelating agents described in U.S. Pat. No. 4,083,723; the antioxidants described in West German Patent Publication (OLS) 2,622,950, etc.

In the case of applying color photographic processing, the color photographic light-sensitive material is usually subjected to bleach processing after the color development. The bleach processing may be carried out simultaneously with fix processing or may be carried out separately from fix processing.

As a fixing agent, a compound of a polyvalent metal such as iron(III), cobalt(III), chromium(IV), copper(II), etc.; peracids, quinones, nitroso compounds, etc., are used. For example, ferricyanides, dichromates, an organic complex of iron(III) or cobalt(III), complex salts of aminopolycarboxylic acids such as ethylenediaminetetraacetic acid, nitrotriacetic acid, 1,3-diamino-2-propanoltetraacetic acid, etc., or organic acids such as citric acid, tartaric acid, malic acid, etc.; persulfates; permanganats; nitrosophenol, etc., can be used. In these compounds, potassium ferricyanate, ethylenediaminetetraacetic acid iron(III) sodium and ethylenediaminetetraacetic acid iron(III) ammonium are particularly useful. The ethylenediaminetetraacetic acid iron(III) complex salt is useful for an independent bleaching solution or a mono-bath bleach-fixing (blixing) solution.

The bleaching solutions or the bleach-fixing solutions may further contain the bleach accelerators described in U.S. Pat. Nos. 3,042,520 and 3,241,966, JP-B-45-8506, JP-B-45-8836 (the term "JP-B" as used herein means an "examined published Japanese patent application"), the thiol compounds described in JP-A-53-65732; and other various additives. Also, after bleach processing or bleach-fix processing, water-washing processing may be applied or a stabilization bath processing only may be applied.

Then, the present invention is described in more detail by the following examples.

EXAMPLE 1

(Preparation of pure silver chloride regular crystal grains)

To one liter of water placed in a vessel were added 4.8 g of sodium chloride and 30 g of inactive gelatin and then into the vessel kept at 60° C. were added 600 ml of an aqueous silver nitrate solution (21.3 g of silver nitrate) and 600 ml of an aqueous sodium chloride solution (7.74 g of sodium chloride) with stirring by a double jet method over a period of 20 minutes. After 5 minutes from finishing the addition, the crystal habit controlling agent shown in Table 1 was added thereto. Then, after 5 minutes from the addition of the crystal habit controlling agent, 300 ml of an aqueous silver nitrate solution (112.5 g of silver nitrate) and 300 ml of an aqueous sodium chloride solution (40.14 g of sodium chloride) were added thereto over a period of 60 minutes. In this case, however, in the case of Grains 2 (see, Table 1), at adding 65 g of silver nitrate, the total amount of the crystal habit controlling agent was added.

Thereafter, the temperature was lowered to 40° C. and after adding an aqueous solution containing an anionic precipitant to make the total amount 3 liters, pH of the system was lowered using sulfuric acid until silver halide grains precipitated. Then, the supernatant liquid of 85% of the total volume was removed (1st water-washing). Furthermore, after adding distilled water of a same amount as the removed liquid, sulfuric acid was added thereto until silver halide grains precipitated. Then, the supernatant liquid of an amount of 85% of the total volume was removed (2nd water-washing). The same operation as the 2nd water washing was repeated once (3rd water-washing) to finish the desalting step.

Then, 80 g of gelatin, 85 ml of phenol (5%), and 242 ml of distilled water were added thereto and pH and pAg thereof were adjusted to 6.2 and 7.5, respectively with an aqueous sodium hydroxide solution and an aqueous silver nitrate solution.

Thus, pure silver chloride grains having an average sphere-corresponding diameter of 0.55 $\mu$m were obtained. The forms of the silver chloride grains obtained are shown in Table 1 below.

TABLE 1

| Grains | CHCA* | Amount (mol/mol-Ag) | Form of Grain | Addition Time of CHCA |
|---|---|---|---|---|
| 1 | — | — | Cubic | |
| 2 | CHCA-1 | $3.0 \times 10^{3}$ | Tetradeca-hedral | At addition of 65 g of $AgNO_3$ |
| 3 | " | $3.0 \times 10^{-3}$ | Octahedral | At addition of 7.74 g of $AgNO_3$ |
| 4 | CHCA-A | $1.5 \times 10^{-3}$ | Octahedral | At addition of 7.74 g of $AgNO_3$ |
| 5 | CHCA-B | $4.0 \times 10^{-3}$ | Octahedral | At addition of 7.74 g of $AgNO_3$ |

(*): CHCA: Crystal habit controlling agent
Grains Nos. 1, 4, and 5 are comparative samples.
Grains Nos. 2 and 3 are samples of the present invention.
CHCA-1 is Compound 1 of the present invention.

Crystal Habit Controlling Agent-A:

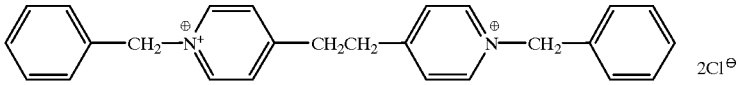

Crystal Habit Controlling Agent-B:

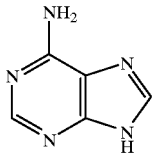

(Preparation of Emulsion Coating Liquid)

To each silver halide emulsion containing each of Grains 3 to 5 was added Sensitizing Dye-1 in an amount of $5\times10^{-4}$ mol/mol-Ag and the emulsion was stirred for 30 minutes at 60° C. Furthermore, the following chemicals were added thereto per mol of the silver halide to provide each emulsion coating solution.

| | |
|---|---|
| Gelatin | 120 g |
| Compound-1 | 1.6 g |
| Compound-2 | 1.6 g |

After adjusting pH of each emulsion coating solution to 6.0, each emulsion coating solution was coated on a TAC base together with a surface protective layer coating solution at a silver coverage of 1.4 g/m$^2$ to provide Coated Samples A to C.

Sensitizing Dye-1:

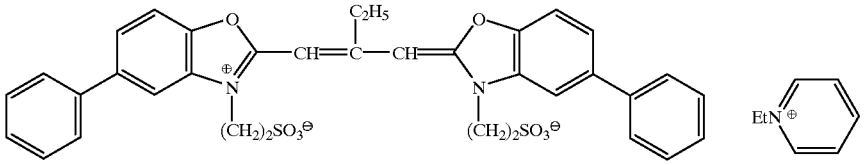

Compound-1:

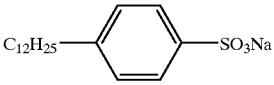

Compound-2:

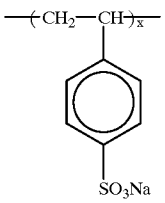

(Evaluation of Dye Adsorption)

The absorption of each of Coated Samples 3 to 5 prepared above was shown in Table 2 below. The absorption was measured using U3400-type Spectrophotometer made by Hitachi, Ltd. The sensitizing dye used in the example is a green-sensitive dye and forms a J band at 550 nm. The sample produced using the compound of the present invention showed the best absorption of the dye.

TABLE 2

| Sample | Grains | Absorption at 550 nm |
|---|---|---|
| A (Invention) | 3 | 56% |
| B (Comparison) | 4 | 45% |
| C (Comparison) | 5 | 8% |

EXAMPLE 2

(Preparation of Pure Silver Chloride Tabular Grains of the Present Invention)

To 1.68 liters of water placed in a vessel were added 3.8 g of sodium chloride, 3 mmols of Crystal Habit Controlling Agent-1 of the present invention and 10 g of inactive gelatin, and then 28.8 ml of an aqueous silver nitrate solution (7.34 g of silver nitrate) and 28.8 ml of an aqueous sodium chloride solution (2.71 g of sodium chloride) were added into the vessel kept at 30° C. with stirring by a double jet method over a period of one minute. After 2 minutes from the addition of the solutions, 188 g of an aqueous solution of 10% inactive gelatin was added thereto. During the next 15 minutes, the temperature of the reaction vessel was raised to 75° C. After ripening the mixture for 12 minutes at 75° C., 480 ml of an aqueous silver nitrate solution (122.7 g of silver nitrate) and an aqueous sodium chloride solution were added at an accelerated flow rate over a period of 39 minutes. During the addition of the solutions, the potential was maintained at +100 mV to a saturated calomel electrode.

Thereafter, the temperature was lowered to 40° C. and after adding thereto an aqueous solution containing an anionic precipitant to make the total volume 3 liters, pH thereof was lowered using sulfuric acid until silver halide grains precipitated.

Then, the supernatant liquid of 85% of the total volume was removed (1st water-washing). Furthermore, after adding distilled water of a same amount as the removed liquid, sulfuric acid was added thereto until silver halide grains precipitated. Then, the supernatant liquid of an amount of 85% of the total volume was removed (2nd water-washing). The same operation as the 2nd water-washing was repeated once (3rd water-washing) to finish the desalting step.

Then, 80 g of gelatin, 85 ml of phenol (5%), and 242 ml of distilled water were added thereto and pH and pAg thereof were adjusted to 6.2 and 7.5, respectively with an aqueous sodium hydroxide solution and an aqueous silver nitrate solution.

Thus, pure silver chloride grains having an average sphere-corresponding diameter of 0.85 μm and the average thickness of 0.12 μm were obtained. The electron photomicrograph of the grain structure is shown in FIG. 1.

(Preparation of Comparative Pure Silver Chloride Tabular Grains)

To 1.68 liters of water placed in a vessel were added 3.8 g of sodium chloride, 1.5 mmols of Crystal Habit Controlling Agent-A used in Example 1, and 30 g of inactive gelatin and 28.8 ml of an aqueous silver nitrate solution (7.34 g of silver nitrate) and 28.8 ml of an aqueous sodium chloride solution (2.71 g of sodium chloride) were added into the vessel kept at 30° C. with stirring by a double jet method over a period of one minute. During the next 15 minutes, the temperature of the reaction vessel was raised to 75° C. After ripening the mixture for 12 minutes at 75° C., 480 ml of an aqueous silver nitrate solution (122.7 g of silver nitrate) and an aqueous sodium chloride solution were added at an accelerated flow rate over a period of 39 minutes. During the addition of the solutions, the potential was maintained at +100 mV to a saturated calomel electrode.

Thereafter, the temperature was lowered to 40° C. and after adding thereto an aqueous solution containing an anionic precipitant to make the total volume 3 liters, pH thereof was lowered using sulfuric acid until silver halide grains precipitated.

Then, the supernatant liquid of 85% of the total volume was removed (1st water-washing). Furthermore, after adding distilled water of a same amount as the removed liquid, sulfuric acid was added thereto until silver halide grains precipitated. Then, the supernatant liquid of an amount of 85% of the total volume was removed (2nd water-washing). The same operation as the 2nd water-washing was repeated once (3rd water-washing) to finish the desalting step.

Then, 80 g of gelatin, 85 ml of phenol (5%), and 242 ml of distilled water were added thereto and pH and pAg thereof were adjusted to 6.2 and 7.5, respectively with an aqueous sodium hydroxide solution and an aqueous silver nitrate solution.

Thus, pure silver chloride grains having an average sphere-corresponding diameter of 0.86 μm and the average thickness of 0.11 μm were obtained.

Each of the two silver halide emulsions obtained above was subjected to a chemical sensitization with stirring at a state of being maintained at 56° C. First, pure silver bromide fine grains having a sphere-corresponding diameter of 0.05 μm were added to the emulsion in an amount of 0.01 mol per mol of silver chloride. After 10 minutes since then, Sensitizing Dye-2 and Sensitizing Dye-3 were added to the emulsion and after 5 minutes since then, $6\times10^{-4}$ mol/mol-Ag of 4-hydroxy-6-methyl-1,3,3a,7-tetraazaindene was added thereto and further 0.5 g of an aqueous calcium chloride solution was added. Then, $4.4\times10^{-6}$ mol/mol-Ag of sodium thiosulfate, $2.2\times10^{-6}$ mol/mol-Ag of Selenium Compound-1, and $1.0\times10^{-5}$ mol/mol-Ag of chloroauric acid were added thereto and after 30 minutes since then, the emulsion as cooled to 35° C. Thus, Emulsion D (Invention) and Emulsion E (Comparison) were obtained.

Sensitizing Dye-2:

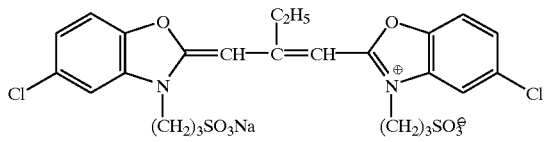

$1\times10^{-3}$ mol/mol-Ag

Sensitizing Dye-3:

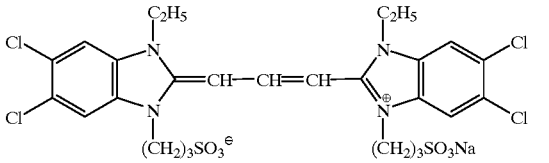

$1\times10^{-5}$ mol/mol-Ag

Selenium Compound-1:

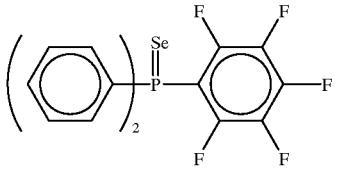

(Preparation of Emulsion Coated Solution)

By adding the following chemicals to each of the Emulsion D and Emulsion E which were subjected to the chemical sensitization, each coating solution was prepared.

| | |
|---|---|
| Gelatin | 111 g |
| 2,6-Bis(hydroxyamino)-4-diethylamino-1,3,5-triazine | 0.11 g |
| Dextran (average molecular weight: 39,000) | 18.5 g |
| Sodium polyacrylate (average molecular weight: 400,000) | 5.1 g |
| Sodium polystyrenesulfonate (average molecular weight: 600,000) | 1.8 g |
| Compound-3 | 0.04 g |
| Compound-4 | 10.3 g |
| Compound-5 | 0.08 g |
| Compound-6 | 0.43 g |
| Compound-7 | 0.004 g |
| Compound-8 | 0.10 g |
| Compound-9 | 0.10 g |
| Hardening agent (1,2-bis(vinylsulfonylacetamido)ethane) | adjusted to a swelling ratio of 230% |

pH adjusted to 6.1 with NaOH.

Compound-3

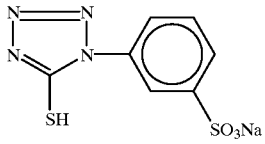

Compound-4

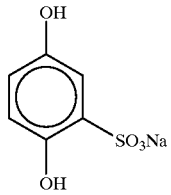

Compound-5

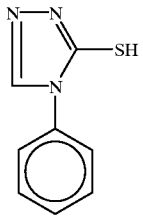

Compound-6

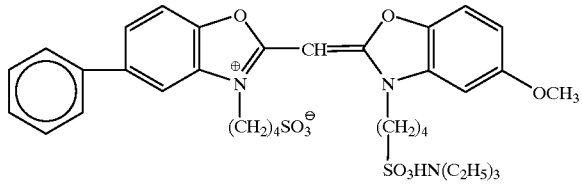

-continued

Compound-7

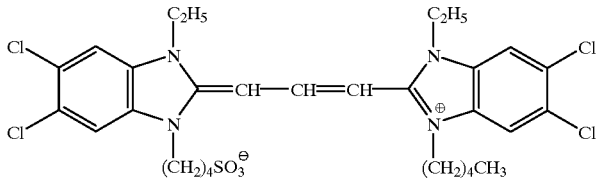

Compound-8

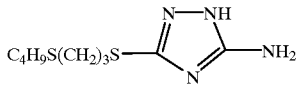

Compound-9

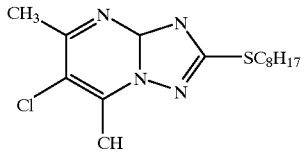

To each of the coating solutions prepared above was added a dye emulsion A shown below such that the coverage of Dye-I became 10 mg/m$^2$ per one surface (i.e., one side).

Dye-I:

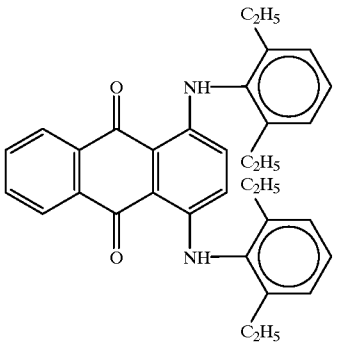

(Preparation of Dye Emulsion A)

In a mixture of 62.8 g of the following high-boiling organic Solvent-I, 62.8 g of the following high-boiling organic Solvent-II, and 333 g of ethyl acetate was dissolved 60 g of Dye-I described above. Then, after adding 65 ml of a 5% aqueous solution of sodium dodecylsulfonate, 94 g of gelatin, and 581 ml of water to the solution, the resultant mixture was dispersed by emulsification for 30 minutes at 60° C. Then, 2 g of the following Compound-10 and 6 liters of water were added to the dispersion and the temperature was lowered to 40° C. Then, the mixture was concentrated using a ultrafiltration, Labomodule ACP1050 (manufactured by Asahi Chemical Industry Co., Ltd.), until the total amount became 2 kg and 1 g of the following Compound-10 was added thereto to provide Dye Emulsion A.

High-Boiling Organic Solvent-I:

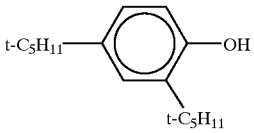

High-Boiling Organic Solvent-II:

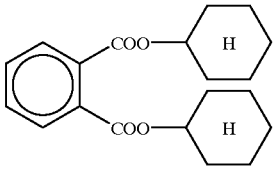

Compound-10:

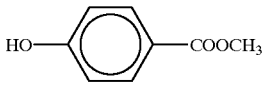

(Preparation of Surface Protective Layer Coating Solution)

The surface protective layer coating solution was prepared using the following components such that the coated amount of each component became as shown below.

| | (g/m$^2$) |
|---|---|
| Gelatin | 0.780 |
| Sodium polyacrylate (average molecular weight: 400,000) | 0.035 |
| Sodium polystyrenesulfonate (average molecular weight: 600,000) | 0.0012 |
| Polymethyl methacrylate (average particle size: 3.7 $\mu$m) | 0.040 |
| (Methyl methacrylate/styrene/methacrylic acid) Copolymer | 0.040 |

-continued

| | (g/m²) |
|---|---|
| (average particle size: 3.8 μm) | |
| Coating Aid-I | 0.020 |
| Coating Aid-II | 0.037 |
| Coating Aid-III | 0.0080 |
| Coating Aid-IV | 0.0032 |
| Coating Aid-V | 0.0025 |
| Coating Aid-VI | 0.0022 |
| Proxel | 0.0010 |
| pH adjusted to 6.8 with NaOH | |

Coating Aid-I:

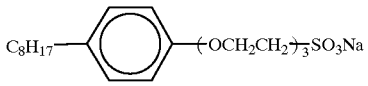

Coating Aid-II:

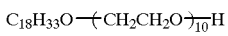

Coating Aid-III:

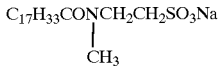

Coating Aid-IV:

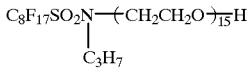

Coating Aid-V:

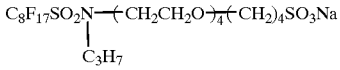

Coating Aid-VI:

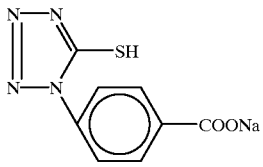

(Preparation of Support)

(1) Preparation of Dye Dispersion B for Subbing Layer:

The following Dye-II was subjected to the ball mill treatment by the method described in JP-A-63-197943.

Dye-II:

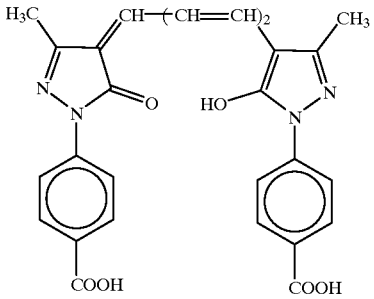

In a 2-liter ball mill were placed 434 ml of water and 791 ml of a 6.7%-aqueous solution of a surface active agent, Triton X200 (i.e., TX200, registered trade mark, made by ROHM AND HAAS CO.). Then, 20 g of the dye was added to the solution. Thereafter, 400 ml of the beads (diameter: 2 mm) of zirconium oxide ($ZrO_2$) was added to the mixture and the mixture was ground for 4 days. Thereafter, 160 g of a 12.5%-aqueous solution of gelatin was added. After defoaming, the $ZrO_2$ beads were removed by filtration. When the dye dispersion obtained was observed, the particle sizes of the ground dye had a wide range of from 0.05 to 1.15 μm and the average particle size was 0.37 μm.

Furthermore, by applying a centrifugal separation, the dye particles having a particle size of 0.9 μm or more were removed.

Thus, the dye dispersion B was obtained.

(2) Preparation of Support:

Corona discharging was applied onto a biaxially stretched polyethylene terephthalate film having a thickness of 175 μm, the 1st subbing solution having the following composition was coated on the film by a wire bar coater such that the coated amount became 4.9 ml/m², and dried at 185° C. for one minute.

Then, the 1st subbing layer was also formed on the opposite surface of the film by the same manner as above.

The used polyethylene phthalate contained 0.04 wt % of Dye-I described above.

Composition for 1st Subbing Layer:

| | |
|---|---|
| Butadiene-styrene copolymer latex solution (solid component: 40%; butadiene/styrene = 31/69 by weight) | 158 ml |
| 4%-Solution of 2,4-dichloro-6-hydroxy-s-triazine sodium salt | 41 ml |
| Distilled water | 801 ml |

*: The latex solution contained the following compound as an emulsification dispersing agent in an amount of 0.4% by weight to the solid component of the latex.

Emulsification Dispersing Agent:

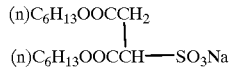

(3) Coating of Subbing Layer

The 2nd subbing layer composed of the following composition was coated on each 1st subbing layer formed on both surfaces of the film by a wire bar coater system such that the coated amount of each component became as shown below and dried at 155° C.

Composition of the 2nd Subbing Layer:

| | (mg/m²) |
|---|---|
| Gelatin | 80 |
| Dye Dispersion B (as dye solid component) | 8 |
| Coating Aid-VII | 1.8 |
| Compound-11 | 0.27 |
| Matting Agent (polymethyl methacrylate having an average particle size of 2.5 μm) | 2.5 |

Coating Aid-VII:

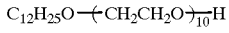

-continued

| | (mg/m$^2$) |
|---|---|

Compound-11:

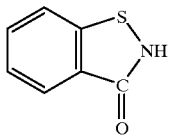

(Preparation of Photographic Material)

Each of the silver halide emulsion layers and the surface protective layer described above were simultaneously coated on both the surfaces of the support thus-prepared by a simultaneous extrusion method to provide Coated Samples D and E. The coated amount of silver per one surface (i.e., one side) was 1.75 g/m$^2$.

(Evaluation of Photographic Properties)

Both surfaces of each photographic material were light-exposed for 0.05 second using X-Ray orthoscreen, HR-4 (made by Fuji Photo Film Co., Ltd.). After exposure, the evaluation of the sensitivity was carried out using the following automatic processor and processing solutions. The sensitivity was shown by the logarithm of the reciprocal of the exposure amount required for giving the density of fog +0.1, the sensitivity of the Emulsion C was defined as 100, and others were represented by the relative values.

(Processing)

Aromatic Processor: CEPROS-30 (Dry to Dry 30 sec.), manufactured by Fuji Photo Film Co., Ltd.

Preparation of Concentrated Processing Solution:

| | |
|---|---|
| [Developer] | |
| Parts A | |
| Potassium Hydroxide | 330 g |
| Potassium Sulfite | 630 g |
| Sodium Sulfite | 255 g |
| Potassium Carbonate | 90 g |
| Boric Acid | 45 g |
| Diethylene Glycol | 180 g |
| Diethylenetriaminepentaacetic Acid | 30 g |
| 1-(N,N-Diethylamine)ethyl-5-mercaptotetrazole | 0.75 g |
| Hydroquinone | 450 g |
| 4-Hydroxymethyl-4-methyl-1-phenyl-3-pyrazolidone | 60 g |
| Water to make | 4125 ml |
| Parts B | |
| Diethylene Glycol | 525 g |
| 3,3'-Dithiobishydrocinnamic Acid | 3 g |
| Glacial Acetic Acid | 102.6 g |
| 2-Nitroindazole | 3.75 g |
| 1-Phenyl-3-pyrazolidone | 34.5 g |
| Water to make | 750 ml |
| Parts C | |
| Glutaraldehyde (50 wt./wt. %) | 150 g |
| Potassium Bromide | 15 g |
| Potassium Metabisulfite | 105 g |
| Water to make | 750 ml |
| [Fixer] | |
| Ammonium Thiosulfate (70 wt./vol. %) | 3000 ml |
| Ethylenediaminetetraacetic Acid.Disodium.-Dihydrate | 0.45 g |
| Sodium Sulfite | 225 g |
| Boric Acid | 60 g |
| 1-(N,N-Diethylamine)-ethyl-5-mercaptotetrazole | 15 g |
| Tartaric Acid | 48 g |
| Glacial Acetic Acid | 675 g |
| Sodium Hydroxide | 225 g |
| Sulfuric Acid (36N) | 58.5 g |
| Aluminum Sulfate | 150 g |
| Water to make | 6000 ml |
| pH | 4.68 |

(Preparation of Processing Solution)

Each of the Parts A, B and C of the concentrated developer described above was filled in each of vessels for the parts. The vessels for the Parts A, B and C are connected each other.

Also, the concentrated fixing solution described above was filled in same kind of vessel.

First, 300 ml of an aqueous solution containing 54 g of acetic acid and 55.5 g of potassium bromide was added into the development bath as a starter.

The vessels in which the processing solutions were filled was inverted, inserted onto the perforating sharp edge of a stock tank for processing solution equipped to the side surface of the automatic processor to tear the sealed membrane of the cap of the vessels, and thus each processing solution in each vessel was filled in the stock tank.

Each of these processing solutions was filled in the developer tank or the fixer tank of the automatic processor at the ratio shown below by operating each pump equipped to the automatic processor.

Also, after processing 8 light-sensitive materials each having an area of 25.4 cm×30.5 cm (i.e., 10 inch×12 inch), a mixture of the concentrated processing solution and water was replenished to the processing tank of the automatic processor at the ratio.

[Developer]

| | |
|---|---|
| Parts A | 51 ml |
| Parts B | 10 ml |
| Parts C | 10 ml |
| Water | 125 ml |
| pH | 10.50 |

[Fixer]

| | |
|---|---|
| Concentrated Fixing Solution | 80 ml |
| Water | 120 ml |
| pH | 4.62 |

In addition, city water was filled in the water-washing tank.

Also, as a fur inhibitor, 3 polyethylene bottles each packed with 0.4 g of pearlite having an average particle size of 100 $\mu$m and average pore size of 3 $\mu$m carrying Actinomyces (the opening portion of the bottle was covered with a nylon cloth of 300 mesh and water and the fungi could passed through the cloth) were prepared, 2 bottles were placed at the bottom of the water-washing tank and one bottle was placed at the bottom of the stock tank (liquid amount: 0.2 liter) of washing water.

Processing Speed and Processing Temperature:

| | | |
|---|---|---|
| Development | 35° C. | 8.8 seconds |
| Fixing | 32° C. | 7.7 seconds |

-continued

| | | |
|---|---|---|
| Washing | 17° C. | 3.8 seconds |
| Squeeze | | 4.4 seconds |
| Drying | 58° C. | 5.3 seconds |
| Total | | 30 seconds |

Replenishing Amount:

| | |
|---|---|
| Developer | 25 ml/10 in. × 12 in. |
| Fixer | 25 ml/10 in. × 12 in. |

The results obtained are shown in Table 3 below.

TABLE 3

| Sample | Emulsion | CHCA* | Sensitivity | Fog |
|---|---|---|---|---|
| D (Invention) | D | 1 | 135 | 0.05 |
| E (Comparison) | E | A | 100 | 0.07 |

(*): Crystal Habit Controlling Agent

As is apparent from the results of Table 3, the light-sensitive material of the present invention shows a high sensitivity and low fog under the Dry to Dry processing of 30 second.

EXAMPLE 3

To each of the silver halide emulsions containing the silver chloride Grains 3, 4, and 5, respectively in Example 1 was added $6\times10^{-4}$ mol/mol-Ag of 4-hydroxy-6-methyl-1,3,3a,7-tetraazaindene and further an aqueous calcium chloride solution was added thereto. Then, $6.6\times10^{-6}$ mol/mol-Ag of sodium thiosulfate, $2.2\times10^{-6}$ mol/mol-Ag of Selenium Compound-1, and $1.0\times10^{-5}$ mol/mol-Ag of chloroauric acid were added to the mixture and after 30 minutes, the resultant mixture was cooled to 35° C. Thus, Emulsion F (Invention), Emulsion G (Comparison), and Emulsion H (Comparison) were obtained.

To each of the emulsions F, G, and H were added the Sensitizing Dye-1 described above, potassium thiocyanate, and Coupler-1 shown below.

Coupler-1:

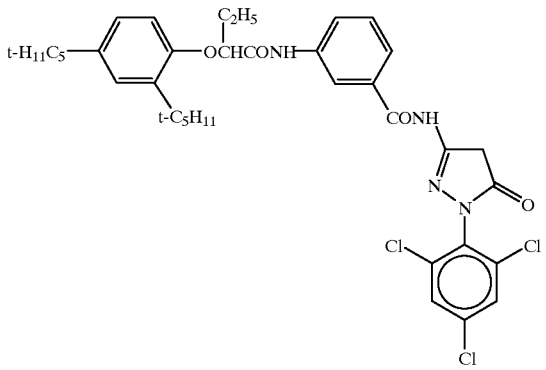

Furthermore, 1-phenyl-5-mercaptotetrazole as an antifoggant, sodium dodecylbenzenesulfonate as a coating aid, tricresyl phosphate, and gelatin was successively added to each emulsion to provide each coating solution.

Each coating solution was coated on a triacetyl cellulose film having thereon a subbing layer together with a protective layer containing sodium salt of 2,4-dichloro-6-hydroxy-1,3,5-triazine to provide Coated Samples F, G, and H.

After applying a wedge-exposure of 365 nm and 550 nm to each of the samples described above using an interference filter, each sample was subjected to the CN16 processing (made by Fuji Photo Film Co., Ltd.) and the photographic property was compared. The results were shown in Table 4 below. The exposure was carried out for 1/100 second. The sensitivity was shown by the logarithm of the reciprocal of the exposure amount required to give the density of fog +0.2 and the sensitivity of Emulsion F was defined as 100.

TABLE 4

| | | Sensitivity | | |
|---|---|---|---|---|
| Sample | Grains | 365 nm | 550 nm | Fog |
| F (Invention) | 3 | 100 | 100 | 0.06 |
| G (Comparison) | 4 | 95 | 80 | 0.08 |
| H (Comparison) | 5 | 38 | 14 | 0.28 |

As is apparent from the results in Table 4, the sample of the present invention shows a high sensitivity and low fog. The superiority in the sensitivity is particularly remarkable in the spectral sensitization range of 550 nm. This is considered to be partially based on the superiority of the dye adsorption as shown in Example 1.

While the invention has been described in detail and with reference to specific embodiments thereof, it will be apparent to one skilled in the art that various changes and modifications can be made therein without departing from the spirit and scope thereof.

What is claimed is:

1. A method for producing a photographic silver halide emulsion containing silver halide grains having a silver chloride content of 50 mol % or more and at least 30% of the surface area of each of the grains comprising (111) faces, wherein said silver halide grains are formed in the presence of at least one compound represented by formula (I):

(I)

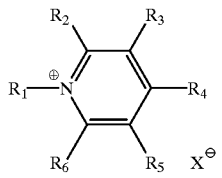

wherein $R_1$ represents an alkyl group, an alkenyl group, or an aralkyl group; $R_2$, $R_3$, $R_4$, $R_5$, and $R_6$ each represent a hydrogen atom or a group capable of substituting for a hydrogen atom; $R_2$ and $R_3$, $R_3$ and $R_4$, $R_4$ and $R_5$, and $R_5$ and $R_6$ each may be ring-condensed, provided that at least one of $R_2$, $R_3$, $R_4$, $R_5$, and $R_6$ represents an aryl group; and $X^-$ represents a counter anion, with the proviso that each of $R_1$, $R_2$, $R_3$, $R_4$, $R_5$, and $R_6$ is (1) a group other than an electrically charged nitrogen-containing heterocyclic ring or, (2) a group other than a group containing an electrically charged nitrogen-containing heterocyclic ring.

2. The method for producing a photographic silver halide emulsion as claimed in claim 1, wherein $R_4$ in the formula (I) represents an aryl group.

3. The method for producing a photographic silver halide emulsion as claimed in claim 1, wherein $R_1$ in the formula (I) represents an aralkyl group.

4. The method for producing a photographic silver halide emulsion as claimed in claim 1, wherein said compound represented by formula (I) is used in an amount of $6\times10^{-5}$ to $6\times10^{-1}$ mol per mol of the silver halide.

5. The method for producing a photographic silver halide emulsion as claimed in claim 1, wherein said silver halide grains comprise regular crystal grains and/or tabular grains.

* * * * *